US009629776B2

(12) United States Patent
Nilsson et al.

(10) Patent No.: US 9,629,776 B2
(45) Date of Patent: Apr. 25, 2017

(54) BACK PLATES FOR MECHANICAL CPR COMPRESSION

(71) Applicant: Physio-Control, Inc., Redmond, WA (US)

(72) Inventors: Anders Nilsson, Åkarp (SE); Anders Torbjörn Jeppsson, Lund (SE)

( * ) Notice: Subject to any disclaimer, the term of this patent is extended or adjusted under 35 U.S.C. 154(b) by 711 days.

(21) Appl. No.: 14/018,858

(22) Filed: Sep. 5, 2013

(65) Prior Publication Data

US 2014/0121576 A1 May 1, 2014

Related U.S. Application Data

(60) Provisional application No. 61/718,649, filed on Oct. 25, 2012.

(51) Int. Cl.
*A61H 31/00* (2006.01)

(52) U.S. Cl.
CPC ..... *A61H 31/006* (2013.01); *A61H 31/008* (2013.01); *A61H 2201/0107* (2013.01); *A61H 2201/0192* (2013.01)

(58) Field of Classification Search
CPC ..... A61H 2201/017; A61H 2201/0192; A61H 2201/0157; A61H 2201/0161; A61H 2201/1253; A61H 2201/1619; A61H 2201/1623; A61H 2201/1626; A61H 31/006; A61H 31/008; A61H 31/007; A61H 2031/001; A61H 2205/084
See application file for complete search history.

(56) References Cited

U.S. PATENT DOCUMENTS 3,201,992 A * 8/1965 Hoff, Jr ..... G01L 7/04 73/431
5,173,996 A * 12/1992 Chou ..... A44B 11/12 24/68 CD
5,287,846 A * 2/1994 Capjon ..... A61H 31/008 601/44
6,447,465 B1 * 9/2002 Sherman ..... A61H 31/00 601/41
2003/0181834 A1 * 9/2003 Sebelius ..... A61H 31/008 601/41

(Continued)

FOREIGN PATENT DOCUMENTS

SE WO 2008066455 A1 * 6/2008 ..... A61H 31/004
WO WO 2010/049861 A1 5/2010
WO WO 2010/119401 A1 10/2010

*Primary Examiner* — Quang D Thanh
(74) *Attorney, Agent, or Firm* — Baker & Hostetler LLP

(57) ABSTRACT

A back plate includes an upper portion, a lower surface defining a plane, a first side, a second side, a plurality of first static attachment elements configured to releasably connect to legs of the compression device, and a plurality of second static attachment elements configured to releasably connect to legs of the compression device. Each of the first and second sides can include one of the plurality of first static attachment elements and one of the plurality of second static attachment elements. The distance between one of the plurality of second static attachment elements on the first side and one of the plurality of second static attachment elements on the second side is greater than a distance between one of the plurality of first static attachment elements on the first side and one of the plurality of first static attachment elements on the second side.

11 Claims, 13 Drawing Sheets

(56) References Cited

U.S. PATENT DOCUMENTS

| | | | | |
|---|---|---|---|---|
| 2005/0080361 | A1* | 4/2005 | Escudero | A61H 31/005 601/44 |
| 2008/0097257 | A1* | 4/2008 | Stromsnes | A61H 31/00 601/41 |
| 2012/0042881 | A1* | 2/2012 | Paulussen | A61H 31/008 128/870 |
| 2012/0238922 | A1 | 9/2012 | Stemple et al. | |

* cited by examiner

BACK PLATES FOR MECHANICAL CPR COMPRESSION

CROSS REFERENCE TO RELATED APPLICATIONS

The present application claims to the benefit of U.S. Provisional Patent Application 61/718,649, filed Oct. 25, 2012, the contents of which are hereby incorporated by reference in their entirety.

BACKGROUND

Cardiopulmonary resuscitation (CPR) is a medical procedure performed on patients to maintain some level of circulatory and respiratory functions when patients otherwise have limited or no circulatory and respiratory functions. CPR is generally not a procedure that restarts circulatory and respiratory functions, but can be effective to preserve enough circulatory and respiratory functions for a patient to survive until the patient's own circulatory and respiratory functions are restored. CPR typically includes frequent chest compressions that usually are performed by pushing on or around the patient's sternum while the patient is laying on the patient's back. For example, chest compressions can be performed as at a rate of about 100 compressions per minute and at a depth of about 5 cm per compression for an adult patient. The frequency and depth of compressions can vary based on a number of factors, such as valid CPR guidelines.

Mechanical CPR has several advantages over manual CPR. A person performing CPR, such as a medical first-responder, must exert considerable physical effort to maintain proper compression timing and depth. Over time, fatigue can set in and compressions can become less regular and less effective. The person performing CPR must also divert mental attention to performing manual CPR properly and may not be able to focus on other tasks that could help the patient. For example, a person performing CPR at a rate of 100 compressions per minute would likely not be able to simultaneously prepare a defibrillator for use to attempt to restart the patient's heart. Mechanical compression devices can be used with CPR to perform compressions that would otherwise be done manually. Mechanical compression devices can provide advantages such as providing constant, proper compressions for sustained lengths of time without fatiguing, freeing medical personal to perform other tasks besides CPR compressions, and being usable in smaller spaces than would be required by a person performing CPR compressions.

SUMMARY

Illustrative embodiments of the present application include, without limitation, methods, structures, and systems. In one embodiment, a back plate includes an upper portion, a lower surface defining a plane, a first side, a second side, a plurality of first static attachment elements configured to releasably connect to legs of the compression device, and a plurality of second static attachment elements configured to releasably connect to legs of the compression device. Each of the first and second sides can include one of the plurality of first static attachment elements and one of the plurality of second static attachment elements. The distance between one of the plurality of second static attachment elements on the first side and one of the plurality of second static attachment elements on the second side is greater than a distance between one of the plurality of first static attachment elements on the first side and one of the plurality of first static attachment elements on the second side.

In one example, the plurality of first static attachment elements and the plurality of second static attachment elements can be formed as integral portions of the back plate. In another example, the plurality of first static attachment elements and the plurality of second static attachment elements can be formed separately from the back plate. The plurality of first static attachment elements and the plurality of second static attachment elements can be shafts, and the shafts can be connected to portions of the back plate via fasteners. In another example, the back plate can include glass reinforced crystalline plastic. In another example, the lower surface can include a plurality of ribs that run from the first side to the second side, and the plane can be defined in part by the plurality of ribs. In yet another example, the distance from the plane to the plurality of second static attachment elements can be greater than the distance from the plane to the plurality of first static attachment elements. In yet another example, each of the first side and the second side can have a curved shape away from the plane.

In another embodiment, a mechanical compression system can include a back plate and a compression device. The back plate can include an upper portion, a first side, a second side, a plurality of first static attachment elements, and a plurality of second static attachment elements. Each of the first and second sides includes one of the plurality of first static attachment elements and one of the plurality of second static attachment elements. The compression device can include a main portion, a first leg rotatably attached to the main portion, and a second leg rotatably attached to the main portion. The first leg can be configured to be releasably connected to one of the plurality of first static attachment elements on the first side and the second leg can be configured to be releasably connected to one of the plurality of first static attachment elements on the second side in a first configuration. The second leg can be configured to be releasably connected to one of the plurality of second static attachment elements on the first side and the second leg can be configured to be releasably connected to one of the plurality of second static attachment elements on the second side in a second configuration. An area bounded by the upper portion, the first leg, the upper portion, and the second leg is larger in the second configuration than in the first configuration. In one example, the compression device can also include a piston configured to extend toward the upper portion of the back plate. The distance from the piston to the upper portion can be greater in the second configuration than in the first configuration.

In another embodiment, a back plate can include a center plate, a first wing, and a second wing. The center plate can have a first surface and a second surface. The first wing can be rotatably connected to a first end of the center plate. The first wing can include a first surface, a second surface, a first static attachment element, and a second static attachment element, where the first surface of the first wing is at an angle with respect to the second surface of the first wing. The second wing can be rotatably connected to a second end of the center plate. The second wing can include a first surface, a second surface, a first static attachment element, and a second static attachment element, where the first surface of the second wing is at an angle with respect to the second surface of the second wing. The first surface of the first wing, the first surface of the center plate, and the first surface of the second wing can be substantially parallel to each other in a first configuration. The second surface of the first wing, the second surface of the center plate, and the second surface of the second wing can be substantially parallel to each other in a second configuration. The distance between the first static attachment element of the first wing and the first static attachment element of the second wing in the first configuration can be substantially similar to the distance between the second static attachment element of the first wing and the second static attachment element of the second wing in the second configuration. The distance between the first static attachment element of the first wing and the first static attachment element of the second wing in the first configuration can also be greater than or less than the distance between the second static attachment element of the first wing and the second static attachment element of the second wing in the second configuration In one example, the first wing can include at least one notched portion near an intersection of the first surface of the first wing and the second surface of the first wing, and the second wing can include at least one notched portion near an intersection of the first surface of the second wing and the second surface of the second wing. The first surface of the center plate can include a first plurality of tabs, and each of the at least one notched portion of the of the first wing and the at least one notched portion of the second wing can be in contact with at least one of the first plurality of tabs in the first configuration. The second surface of the center plate can include a second plurality of tabs, and each of the at least one notched portion of the of the first wing and the at least one notched portion of the second wing can be in contact with at least one of the second plurality of tabs in the second configuration.

In another example, each of the first end of the center plate can include a first wing attachment element and the second end of the center plate can include a first wing attachment element. The first wing can include a first center plate attachment element configured to releasably connect with the first wing attachment element of the center plate, and the second wing can include a second center plate attachment element configured to releasably connected with the second wing attachment element of the center plate. In another example, the first wing, the center plate, and the second wing can include plastic. The first static attachment element of the first wing, the second static attachment element of the first wing, the first static attachment element of the second wing, and the second static attachment element of the second wing can be aluminum shafts. The first static attachment element of the first wing, the second static attachment element of the first wing, the first static attachment element of the second wing, and the second static attachment element of the second wing can also be glass reinforced crystalline plastic that has a plurality of ribs.

BRIEF DESCRIPTION OF THE DRAWINGS

Throughout the drawings, reference numbers may be re-used to indicate correspondence between referenced elements. The drawings are provided to illustrate example embodiments described herein and are not intended to limit the scope of the disclosure.

DETAILED DESCRIPTION OF ILLUSTRATIVE EMBODIMENTS

Mechanical CPR compression devices can provide many advantages over manual CPR compressions. Mechanical CPR compression devices can include a back plate that is placed behind the back of the patient and a compression device located above the patient's sternum area. The compression device can be connected to the back plate on both sides of the patient. When the compression device pushes against the area around the patient's sternum, the back plate provides resistance that allows the compression device to compress the patient's chest. Such mechanical CPR compression devices surround the user's chest, such as in the case of a mechanical CPR device with a back plate behind the patient's back, a compression device above the patient's sternum, and legs along both sides of the user's chest.

One difficulty with using mechanical CPR compression devices is that not all patients have the same sternum height (i.e., the height from the patient's back to the patient's sternum). Additionally, the width of patients' chests can vary from patient to patient. Thus, for a mechanical CPR compression device to be usable on a large number of possible patients, it must be able to accommodate many different chest sizes. Prior mechanical CPR compression devices do not effectively provide for ranges of desired patient sternum heights and patient chest widths. Some mechanical CPR compression devices have a one-size configuration. One-size configuration mechanical CPR compression devices may be usable on a range of patient sizes. However, mechanical CPR compression devices may not fit all desired patient sternum heights and patient chest widths. Other approaches, such as one shown in WO 2010/119401 A1, using sliding mechanisms on the back plate to change location where the compression device connects to the back plate. While these sliding mechanism approaches may increase the range of sternum heights and patient chest widths that can be accommodated by the mechanical CPR compression device, sliding mechanisms have disadvantages. Sliding mechanisms can be difficult to correctly set up, particularly when a user is under pressure to set up a mechanical CPR compression device while a patient is not breathing and does not have any circulatory activity. Moreover, sliding mechanisms that connect a back plate to a compression device may not provide sufficient resistance for the forces needed to compress the patient's chest.

Figure 1A:
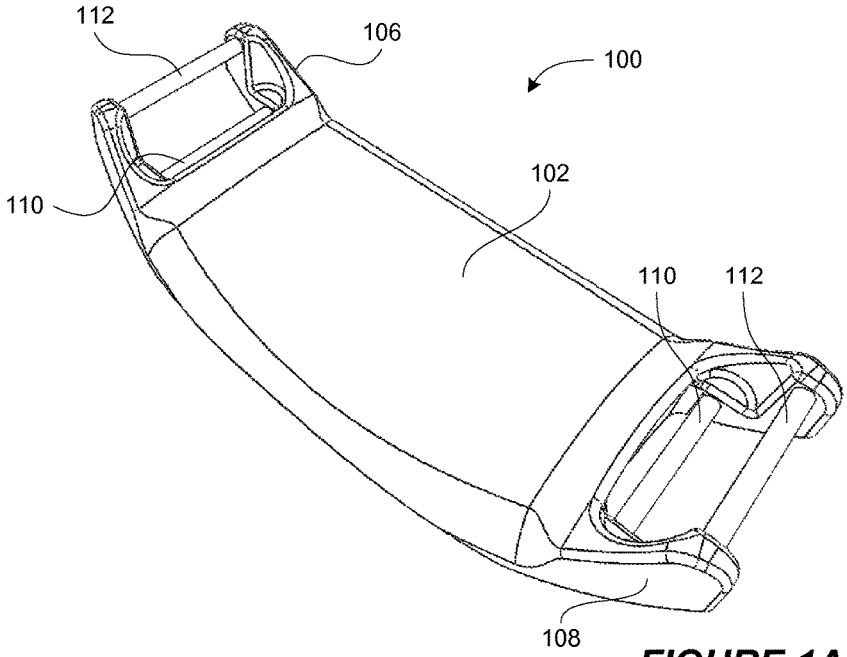
FIGS. 1A and 1B depict an upper perspective view and a lower perspective view, respectively, of an embodiment of a back plate that can be used in a mechanical CPR compression device.
Figure 1B:
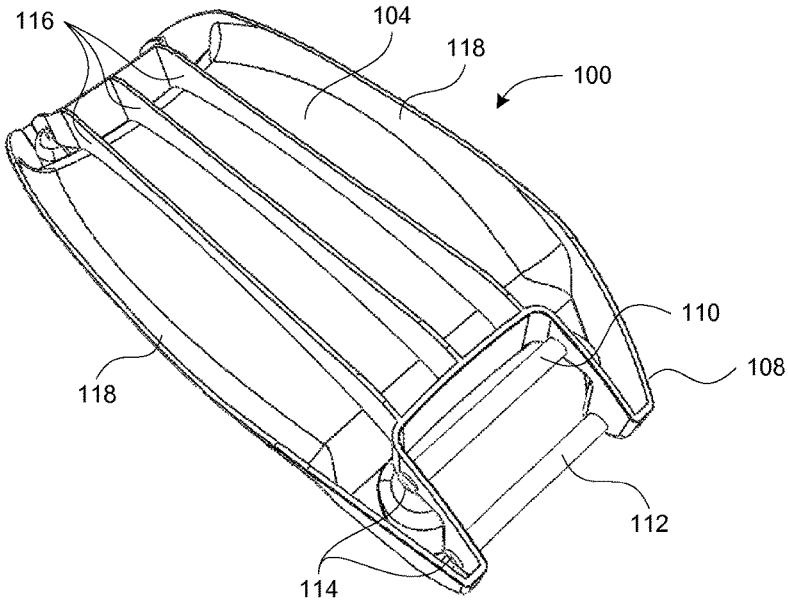

FIGS. 1A and 1B depict an upper perspective view and a lower perspective view, respectively, of an embodiment of a back plate 100 that can be used in a mechanical CPR compression device. Back plate 100 includes an upper portion 102 which can be placed against the back of a patient and a lower surface 104. The back plate 100 can be made of a variety of materials, including plastics, composite materials, and metals. In on embodiment, the back plate 100 can be made of glass reinforced crystalline plastic (Polyamide). The back plate 100 can have a first side 106 and a second side 108.

Each of the first side 106 and second side 108 of back plate 100 includes a first static attachment element 110 and a second static attachment element 112. The first and second static attachment element 110 and 112 are static in that they do not move relative to other portions of the back plate 100. Each of the first and second static attachment elements 110 and 112 can be configured to releasably connect one leg of a compression device to the back plate 100. Items that are releasably connected are easily disconnected by a user, such as connections that can snap in and snap out, connection that do not require the use of tools to disconnect, quick-release connections (e.g., push button release, quarter-turn fastener release, lever release, etc.), and the like. Items are not releaseably connected if they are connected by more permanent fasteners, such as rivets, screws, bolts, and the like. In the embodiment depicted in FIGS. 1A and 1B, the first and second static attachment elements 110 and 112 are in the form of shafts. Such shafts can be formed as integral portions of the back plate 100 or as separate pieces. For example, if the back plate 100 is formed by injection molding of a plastic or plastic-based composite, the first and second static attachment elements 110 and 112 can be formed as an integral portion of the back plate 100 during the injection molding process. In another example, the back plate 100 can be formed separately from the first and second static attachment elements 110 and 112 and the first and second static attachment elements 110 and 112 can be attached to the back plate 100. In the embodiment shown in FIG. 1B, the first and second static attachment elements 110 and 112 are separate from the back plate 100 and are attached to the back plate 100 using fasteners 114. In such a case, the first and second static attachment elements 110 and 112 could be aluminum rods or any other suitable material. The first static attachment elements 110 can define a first configuration for attaching legs of a compression device and the second attachment elements 110 can define a second configuration for attaching legs of a compression device.

As shown in the embodiment depicted in FIG. 1B, the lower surface 104 can include ribs 116 and sides 118 that run from the first side 106 to the second side 108. The ribs 116 and sides 118 can provide structural rigidity without adding significant weight to the back plate 100. The ribs 116 and sides 118 can also define a plane for placing the back plate 100 on a surface, such as a floor or bed. With the back plate 100 being mostly hollow and having ribs 116 and/or sides 118 to provide structural rigidity, the back plate 100 can provide the strength required with a minimal amount of weight.

Figure 2A:
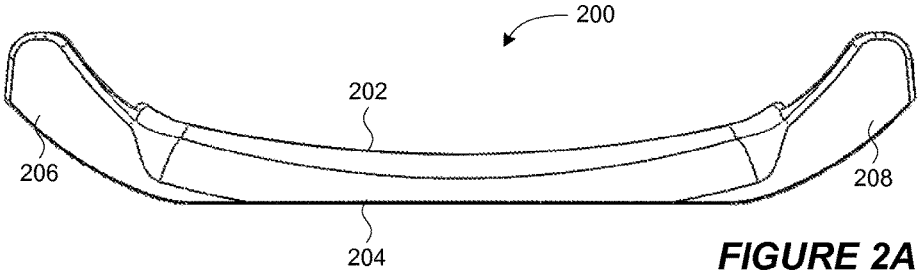
FIGS. 2A to 2D depict a side view, a top view, a cross-sectional side view, and a bottom view, respectively, of an embodiment of a back plate that can be used in a mechanical CPR compression device.
Figure 2B:
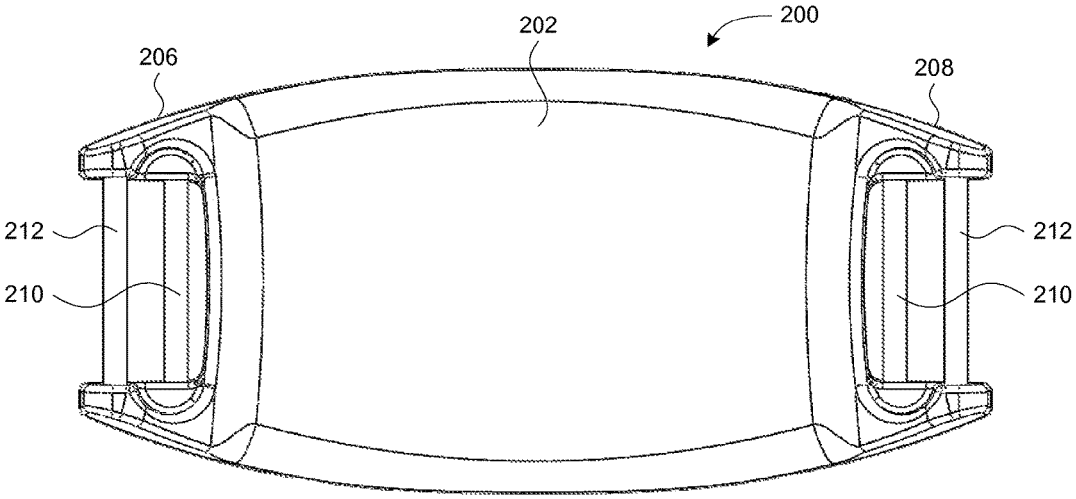
Figure 2C:
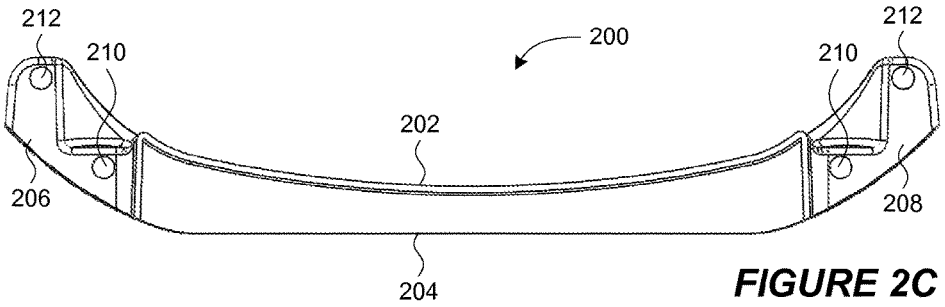
Figure 2D:
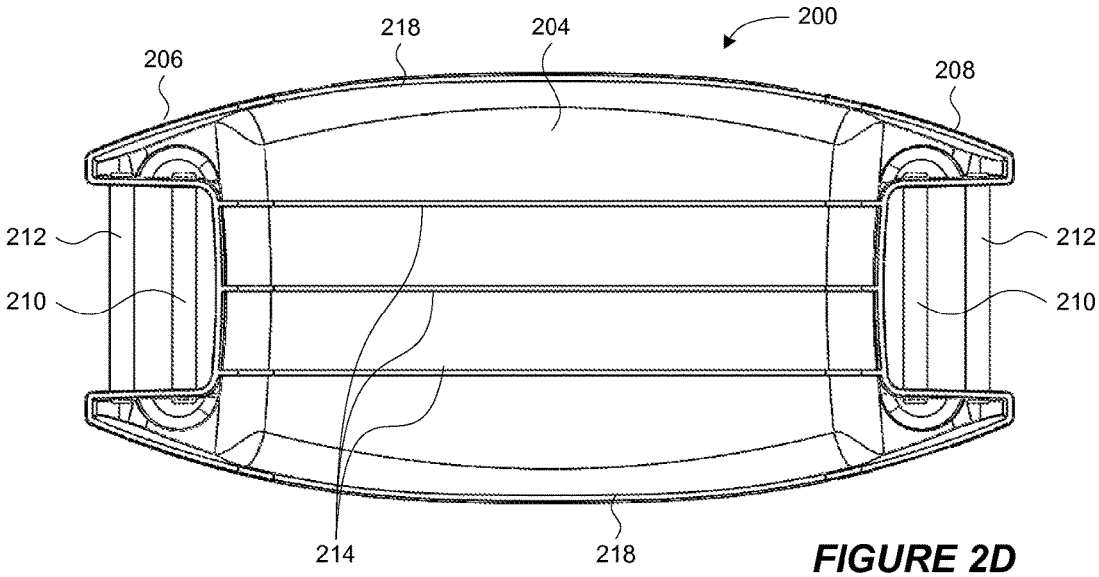

FIGS. 2A to 2D depict a side view, a top view, a cross-sectional side view, and a bottom view, respectively, of an embodiment of a back plate 200 that can be used in a mechanical CPR compression device. Back plate 200 can have an upper portion 202 and a lower portion 204. The back plate 200 has a first side 206 and a second side 208. As shown in FIGS. 2A and 2C, the sides 206 and 208 can have a curvature such that, when the lower portion 204 of the back plate 200 is placed on a surface, the sides 206 and 208 of the back plate 200 would not touch the surface. Including such a curvature in the sides 206 and 208 of back plate 200 may save weight in the back plate 200 and may make it easier for the back plate to be slid underneath a patient that is laying down.

Each of the first side 206 and second side 208 of back plate 200 includes a first static attachment element 210 and a second static attachment element 212. Each of the first and second static attachment elements 210 and 212 can be configured to releasably connect one leg of a compression device to the back plate 200. In the embodiment shown in FIGS. 2B to 2D, the first and second static attachment elements 210 and 212 are in the form of shafts. As shown in the cross-sectional view depicted in FIG. 2C, the distance between the first static attachment element 210 on the first side 206 and the first static attachment element 210 on the second side 208 is smaller than the distance between the second static attachment element 212 on the first side 206 and the second static attachment element 212 on the second side 208. While this distance has been depicted in FIG. 2C as being smaller, in other embodiments the distance could be larger or have any number of different configurations. In addition, the first static attachment elements 210 are located closer to the lower portion 204 than the second static attachment elements 212. The lower portion 204 of the back plate 200 can also include ribs 216 and sides 218. The ribs 216 and the sides 218 can be substantially perpendicular to the lower portion 204 and run from the first side 206 to the second side 208. The ribs 216 and sides 218 can provide structural rigidity without adding significant weight to the back plate 200.

Figure 3B:
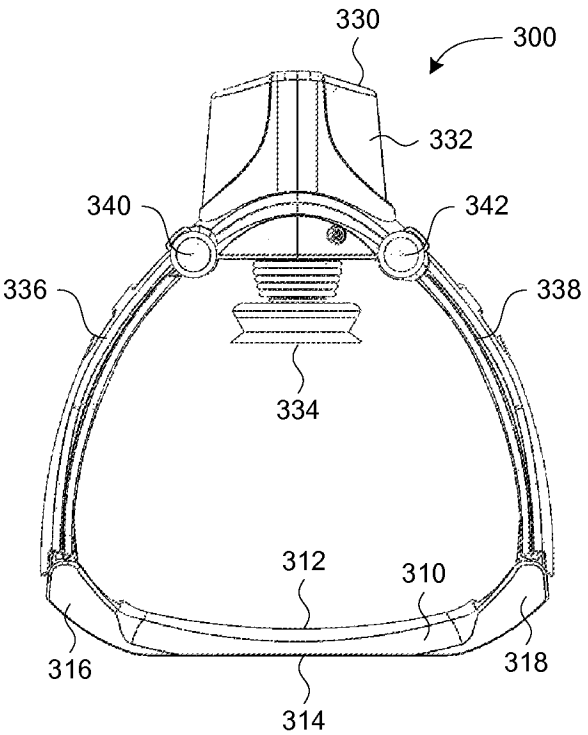
FIGS. 3A and 3B depict two configurations of an embodiment of a mechanical CPR compression device with a back plate and a compression device.
Figure 3A:
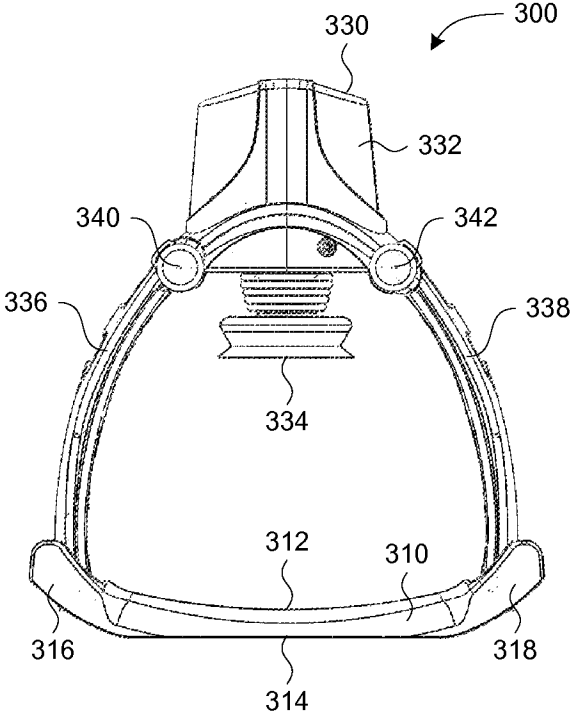

FIGS. 3A and 3B depict two configurations of an embodiment of a mechanical CPR compression device 300 with a back plate 310 and a compression device 330. The back plate 310 includes an upper portion 312 and a lower portion 314. The back plate 310 also has a first side 316 and a second side 318. The compression device 330 includes a main portion 332 with a piston 334 at the bottom. The main portion 332 can include a motor or actuator that drives the piston 334. The compression device 330 also includes a first leg 336 and a second leg 338. The first leg 336 is connected to the main portion 332 via a rotatable joint 340 and the second leg 338 is connected to the main portion 332 via a rotatable joint 342. The rotatable joints 340 and 342 allow the first and second legs 336 and 338 to rotate. In the configuration depicted in FIG. 3A, each of the legs 336 and 338 is releasably connected to a first static attachment element and, in the configuration depicted in FIG. 3B, each of the legs 336 and 338 is releasably connected to a second static attachment element. In operation, a patient can be laid down on the upper portion 312 of the back plate 310 with the patient's sternum positioned under the piston 334. The compression device 330 can extend the piston 334 into the patient's sternum area to cause compression of the patient's chest. In one embodiment, the position of the legs 336 and 338 in FIG. 3B can be the outermost positions to which the legs 336 and 338 can rotate about rotatable joints 340 and 342. This configuration can provide additional stability during operation of the piston 334.

Figure 3C:
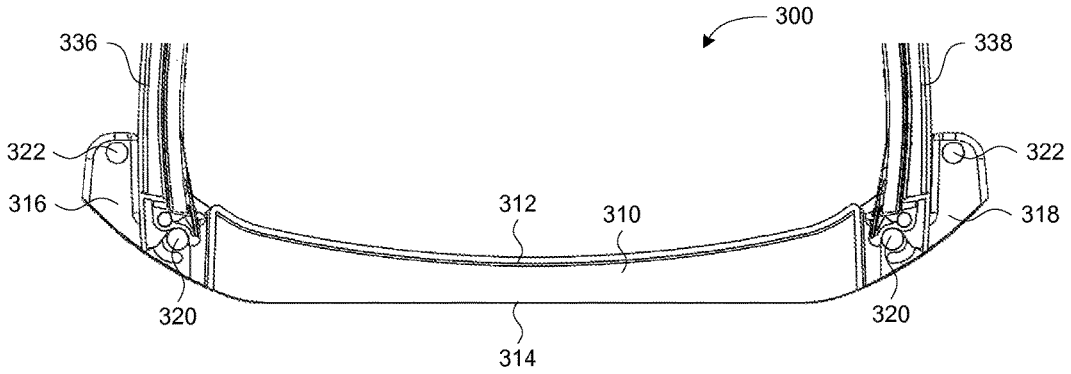
FIGS. 3C and 3D depict partial cross-sectional views of the two configurations of mechanical CPR compression device shown in FIGS. 3A and 3B, respectively.
Figure 3D:
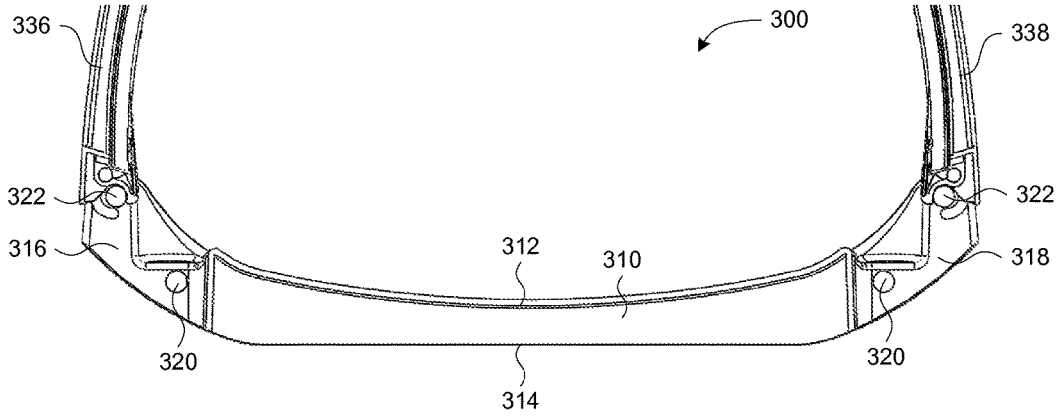

FIGS. 3C and 3D depict partial cross-sectional views of the two configurations of mechanical CPR compression device 300 shown in FIGS. 3A and 3B, respectively. As shown in FIGS. 3C and 3D, back plate 310 includes a first static attachment element 320 on each of sides 316 and 318 and a second static attachment element 322 on each of sides 316 and 318. In the configuration shown in FIG. 3C, leg 336 is releasably connected to first static attachment element 320 on side 316 and leg 338 is releasably connected to first static attachment element 320 on side 318. In the configuration shown in FIG. 3D, leg 336 is releasably connected to second static attachment element 322 on side 316 and leg 338 is releasably connected to second static attachment element 322 on side 318. The configuration depicted in FIGS. 3A and 3C is a smaller configuration and the configuration depicted in FIGS. 3B and 3D is a larger configuration. The distance between the legs 336 and 338 is smaller in the smaller configuration than the distance between the legs 336 and 338 in the larger configuration. Similarly, the distance between the upper portion 312 of back plate 310 and the piston 334 is smaller in the smaller configuration than the distance between the upper portion 312 of back plate 310 and the piston 334 in the larger configuration.

Figure 4B:
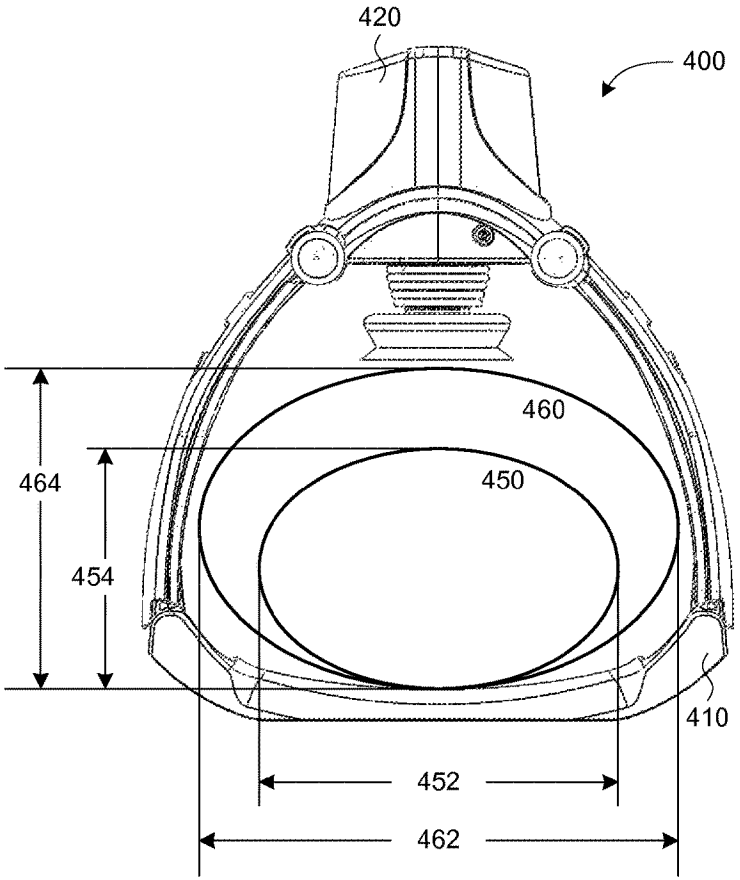
FIGS. 4A and 4B depict a smaller configuration and a larger configuration, respectively, of an embodiment of a mechanical CPR compression device with a back plate and a compression device.
Figure 4A:
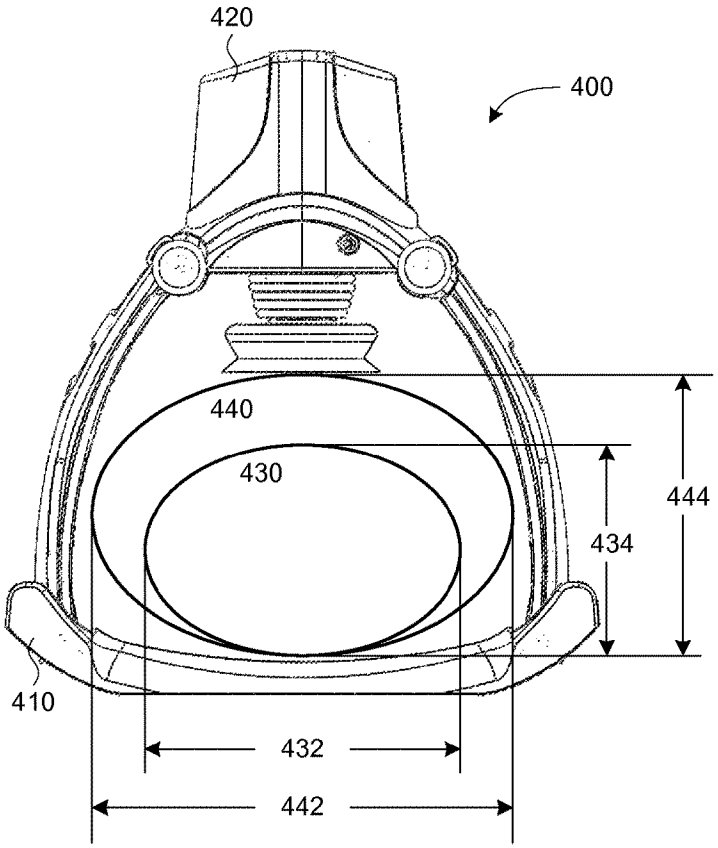

FIGS. 4A and 4B depict a smaller configuration and a larger configuration, respectively, of an embodiment of a mechanical CPR compression device 400 with a back plate 410 and a compression device 420. In the smaller configuration depicted in FIG. 4A, the mechanical CPR compression device 400 can accommodate patient chest sizes in a range from chest size 430 to chest size 440. The chest size 430 has a width 432 and a sternum height 434, and the chest size 440 has a width 442 and a sternum height 444. Thus, in the smaller configuration, mechanical CPR compression device 400 can be used with patients having a chest width between width 432 and width 442, and having a sternum height between sternum height 434 and sternum height 444. In the larger configuration depicted in FIG. 4B, the mechanical CPR compression device 400 can accommodate patient chest sizes in a range from chest size 450 to chest size 460. The chest size 450 has a width 452 and a sternum height 454, and the chest size 460 has a width 462 and a sternum height 464. Thus, in the larger configuration, mechanical CPR compression device 400 can be used with patients having a chest width between width 452 and width 462, and having a sternum height between sternum height 454 and sternum height 464. If chest size 440 is larger than chest size 450, then the mechanical CPR compression device 400 is usable with patients having chest sizes in a range from chest size 430 to chest size 460. In other words, mechanical CPR compression device 400 can be used with patients having a chest width between width 432 and width 462, and having a sternum height between sternum height 434 and sternum height 464.

Figure 5B:
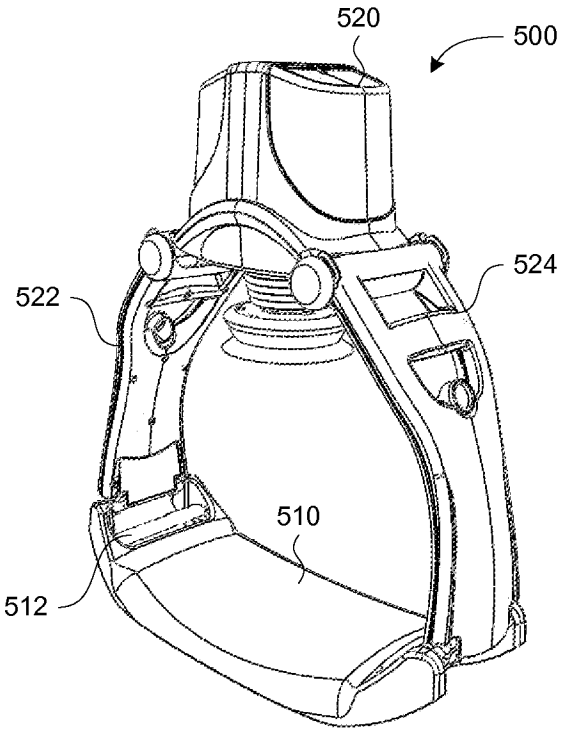
FIGS. 5A and 5B depict perspective views of a smaller configuration and a larger configuration, respectively, of an embodiment of a mechanical CPR compression device with a back plate and a compression device.
Figure 5A:
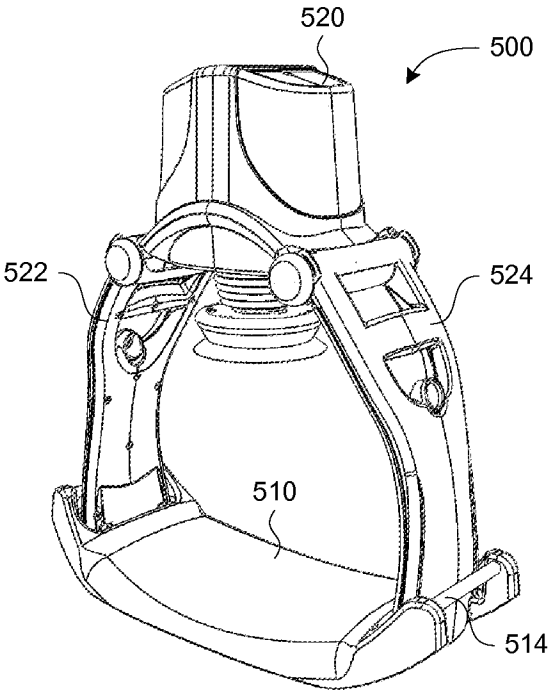

FIGS. 5A and 5B depict perspective views of a smaller configuration and a larger configuration, respectively, of an embodiment of a mechanical CPR compression device 500 with a back plate 510 and a compression device 520. In the smaller configuration depicted in FIG. 5A, each of legs 522 and 524 is releasably connected to one first static attachment element 512 of back plate 510. In the larger configuration depicted in FIG. 5B, each of legs 522 and 524 is releasably connected to one second static attachment element 514 of back plate 510.

Figure 6:
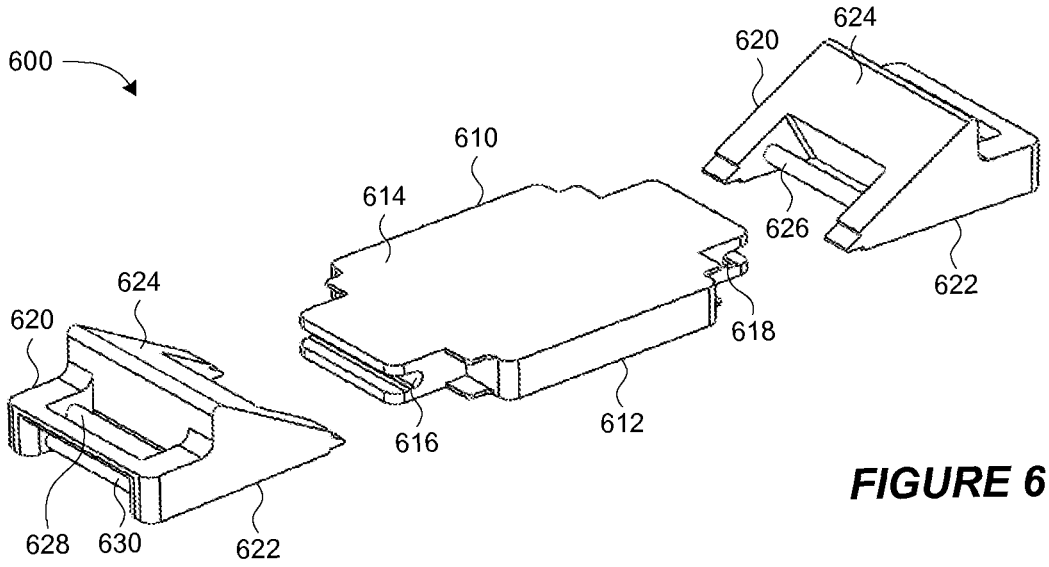
FIG. 6 depicts an embodiment of a back plate having a two-wing configuration.

FIG. 6 depicts an embodiment of a back plate 600 having a two-wing configuration. The back plate 600 includes a center plate 610 and two wings 620. The two wings 620 can have a common shape and size. Center plate 610 can include a first side 612 (the bottom side in the view depicted in FIG. 6) and a second side 614 (the top side depicted in FIG. 6). The center plate 610 can also include a first wing attachment element 616 and a second wing attachment element 618. Each of the wings 620 includes a first surface 622 and a second surface 624. The second surface 624 is at an angle with respect to the first surface 622. Each of the wings 620 also includes a center plate attachment element 626 that can be rotatably connected to either the first wing attachment element 616 of the center plate 610 or the second wing attachment element 618 of the center plate 610. Each of the wings 620 also includes a first static attachment mechanism 628 and a second static attachment element 630 that can be used to connect the wing 620 to a leg of a compression device. Such first and second static attachment mechanisms are discussed in greater detail below.

Figure 7:
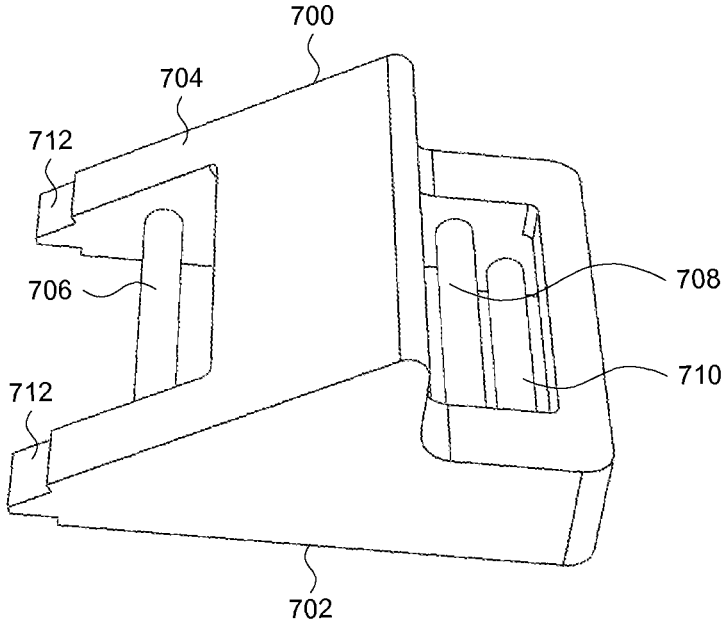
FIG. 7 depicts an embodiment of a wing that can be used with a center plate.

FIG. 7 depicts an embodiment of a wing 700 that can be used with a center plate. The wing 700 includes a first surface 702 and a second surface 704. The second surface 704 is at an angle with respect to the first surface 702. The wing 700 also includes a center plate attachment element 706 that can be rotatably connected to a wing attachment element of a center plate. The wing 700 also includes a first static attachment mechanism 708 and a second static attachment element 710 that can be used to connect the wing 720 to a leg of a compression device. The wing 700 can also include notched portions 712 near vertices of the intersection of the first surface 702 and the second surface 704. Such notched portions will also be discussed in greater detail below.

Figure 8:
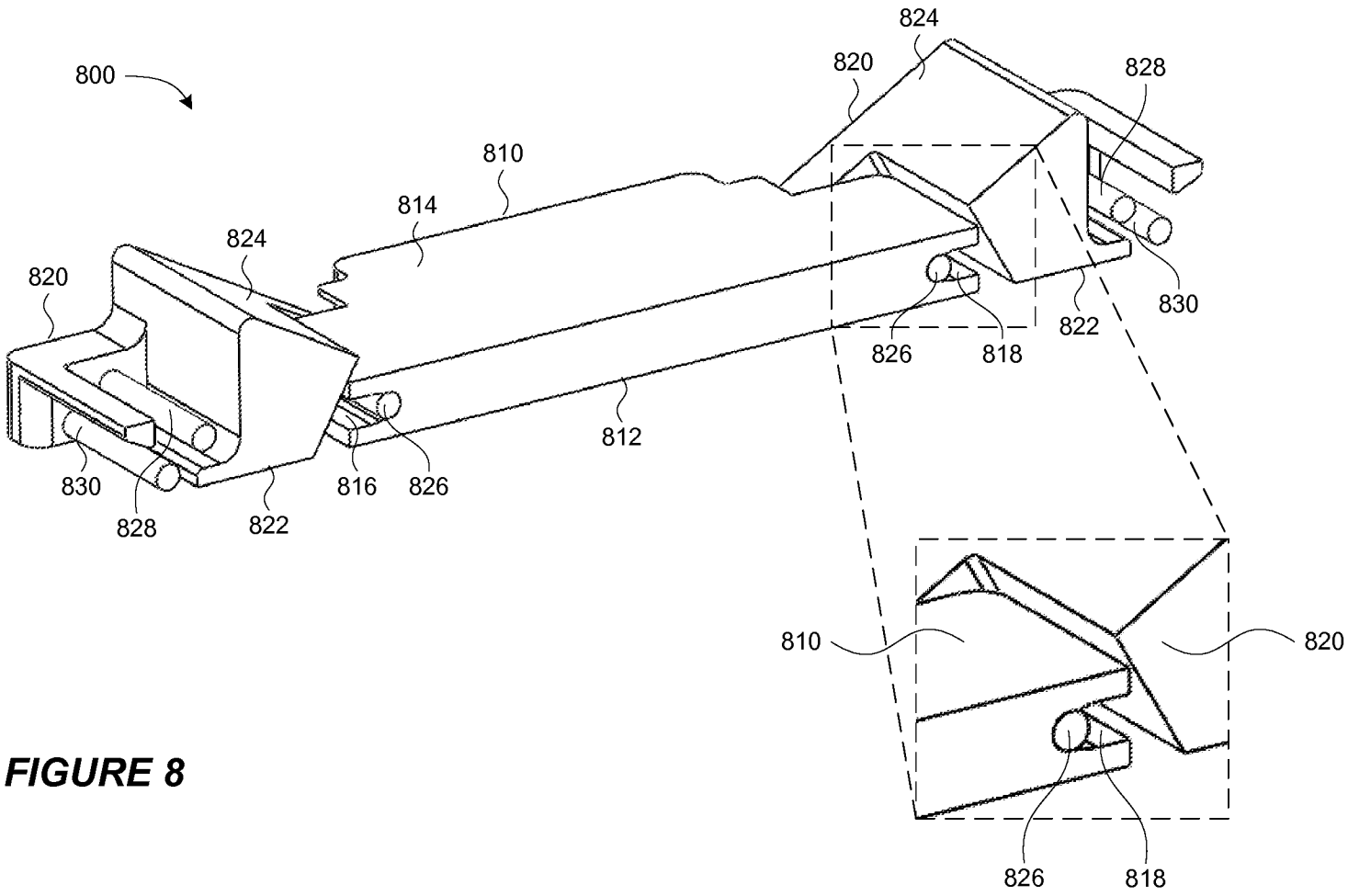
FIG. 8 depicts a cross-sectional view of an embodiment of a back plate having a center plate with two wings attached.

FIG. 8 depicts a cross-sectional view of an embodiment of a back plate 800 having a center plate 810 with two wings 820 attached. Center plate 810 can include a first surface 812 and a second surface 814. The center plate 810 can also include a first wing attachment element 816 and a second wing attachment element 818. Each of the wings 820 includes a first surface 822 and a second surface 824. The second surface 824 is at an angle with respect to the first surface 822. Each of the wings 820 also includes a center plate attachment element 826. In the configuration depicted in FIG. 8, one of the center plate attachment elements 826 is rotatably connected the first wing attachment element 816 of the center plate 810 and the other center plate attachment elements 826 is rotatably connected the second wing attachment element 818 of the center plate 810. Each of the wings 820 also includes a first static attachment mechanism 828 and a second static attachment element 830 that can be used to connect the wing 820 to a leg of a compression device.

In the position of back plate 800 shown in FIG. 8, the first surface 812 of the center plate 810 is substantially parallel with the first surfaces 822 of the wings 820. The wings 820 can rotate about the center plate attachment elements 826 from the position shown in FIG. 8 to a position where the second surface 814 of the center plate 810 is substantially parallel with the second surfaces 824 of the wings 820. In this way, the back plate 800 can be positioned on a flat surface either with the first surface 812 of the center plate 810 and the first surfaces 822 of the wings 820 against the surface or with the second surface 814 of the center plate 810 and the second surfaces 824 of the wings 820 against the flat surface.

Figure 9:
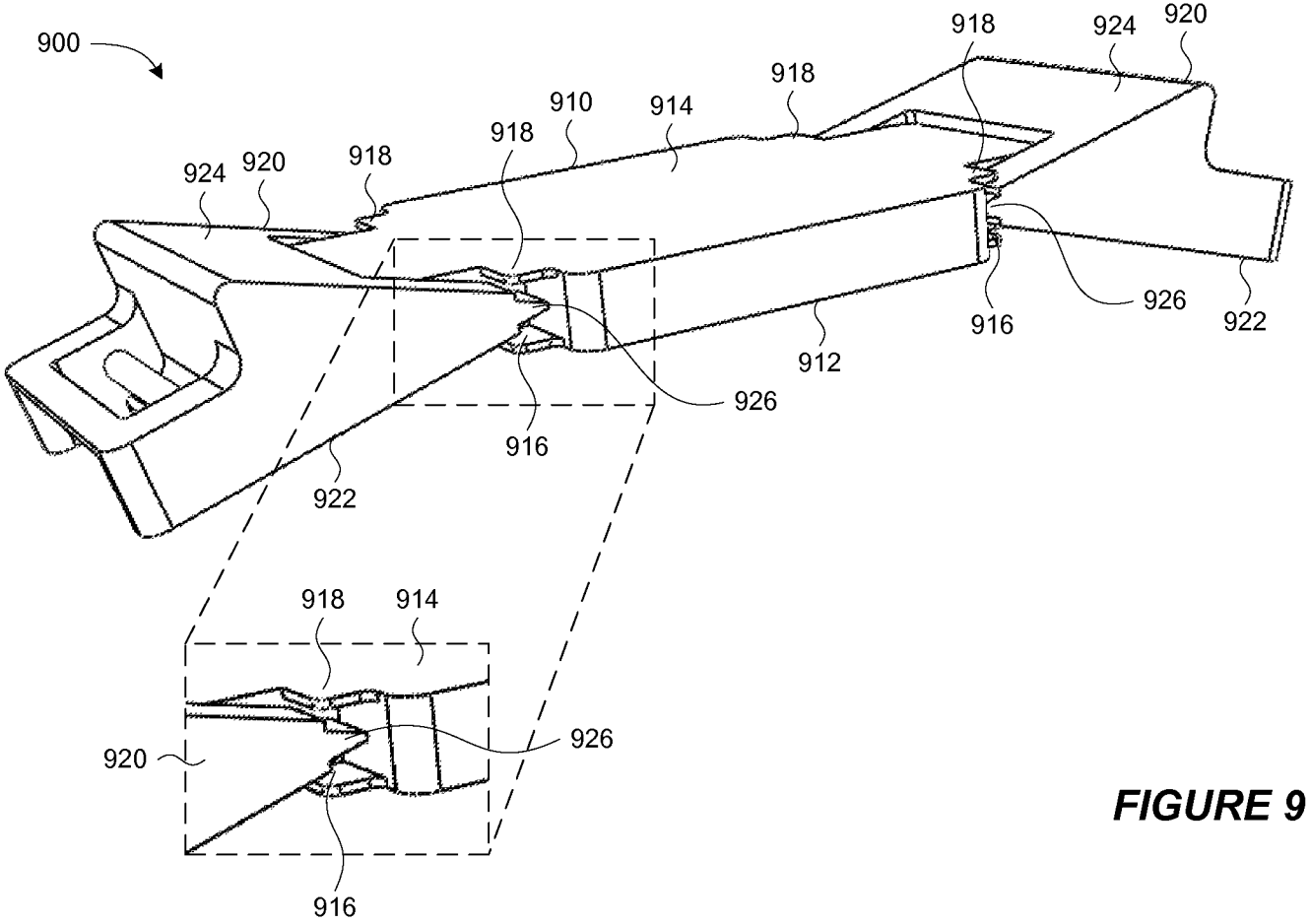
FIG. 9 depicts a view of an embodiment of a back plate having a center plate with two wings attached.

FIG. 9 depicts a view of an embodiment of a back plate 900 having a center plate 910 with two wings 920 attached. Center plate 910 can include a first surface 912 and a second surface 914. The center plate 910 can be rotatably attached to each of the two wings 920. Each of the wings 920 includes a first surface 922 and a second surface 924. The second surface 924 is at an angle with respect to the first surface 922. Each of the wings 820 also includes a notched portion 926 near vertices of the intersection of the first surface 922 and the second surface 924. The center plate 910 also has tabs 916 on the first surface 912 and tabs 916 on the second surface 914. The notched portions 926 can be shaped to fit within the space between one of the tabs 916 and the tabs 918. For ease of use, the wings can be allowed to rotate freely between the position where the noted portions 926 contact the tabs 916 and the position where the notched portions 926 contact the tabs 918. The notched portion 926 and the tabs 916 can be shaped such that the first surface 912 of the center plate 910 is substantially parallel with the first surfaces 922 of the wings 920 when the notched portions 926 are in contact with the tabs 916. The notched portion 926 and the tabs 918 can be shaped such that the second surface 914 of the center plate 910 is substantially parallel with the second surfaces 924 of the wings 920 when the notched portions 926 are in contact with the tabs 916.

FIGS. 10A to 10D depict side and cross-sectional views of a back plate 1000 having a center plate 1010 with two wings 1030 rotatably attached. The center plate 1010 includes a first surface 1012 and a second surface 1014. The first surface 1012 includes tabs 1016 and the second surface includes tabs 1018. Each of the wings 1030 includes a first surface 1032 and a second surface 1034. The second surface 1034 is at an angle with respect to the first surface 1032. The wings 1030 can include notched portions 1036 located near the vertices of the intersections of the first surface 1032 and the second surface 1034. Each of the wings 1030 can include a shaft 1038 for rotatably attaching the wing 1030 to the center plate 1010. Each of the wings 1030 also includes a first static attachment mechanism 1040 and a second static attachment element 1042 that can be used to connect the wing 1030 to a leg of a compression device.

Figure 10C:
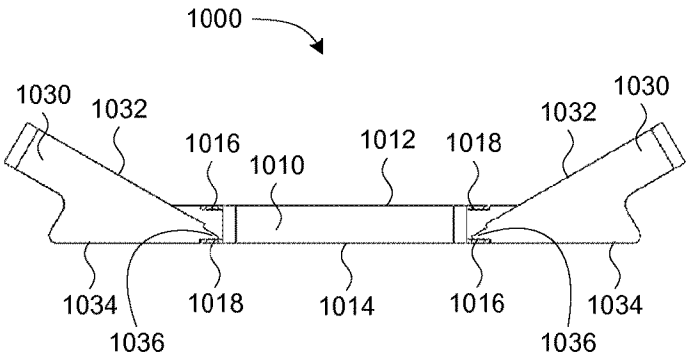
FIGS. 10A to 10D depict side and cross-sectional views of a back plate having a center plate with two wings rotatably attached.
Figure 10A:
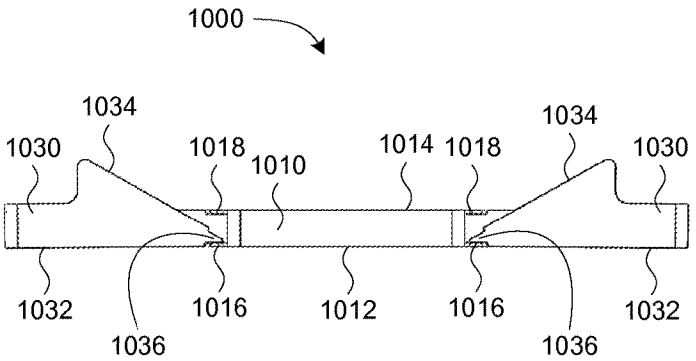

FIG. 10A depicts a side view of back plate 1000 with the notched portions 1036 of wings 1030 in contact with tabs 1016 of center plate 1010. In this configuration, the first surface 1012 of the center plate 1010 is substantially parallel with the first surfaces 1032 of the wings 1030. In this position, as shown in the cross-sectional view of FIG. 10B, the first static attachment elements 1040 are located above the second static attachment elements 1042. The first static attachment elements 1040 are located at a distance 1050 away from each other.

FIG. 10C depicts a side view of back plate 1000 with the notched portions 1036 of wings 1030 in contact with tabs 1018 of center plate 1010. In this configuration, the second surface 1014 of the center plate 1010 is substantially parallel with the second surfaces 1034 of the wings 1030. In this position, as shown in the cross-sectional view of FIG. 10D, the second static attachment elements 1042 are located above the first static attachment elements 1040. The second static attachment elements 1042 are located at a distance 1052 away from each other. If the first and second static attachment elements 1040 and 1042 are properly located with respect to each other, the distances 1050 and 1052 can be the same distance. In this way, legs of a compression device can attach to the first static attachment elements 1040 in FIG. 10B and to the second static attachment elements 1042 in FIG. 10D even if the legs of the compression device have a fixed width.

Figure 10D:
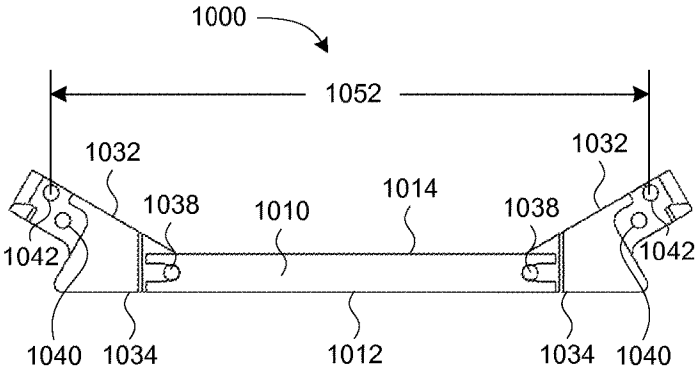
Figure 10B:
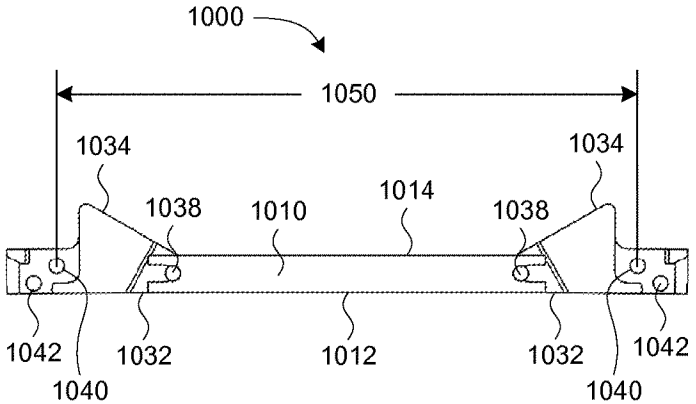

In some embodiments, portions of the back plate 1000 and the wings 1030 can include one or more indications that can aide in proper arrangement or orientation of the back plate 1000 and the wings 1030 in the configurations shown in FIGS. 10A-10D. The one or more indications can include labeling, marking, color coding, and the like, to indicate appropriate surfaces of the back plate 1000 and the wings 1030. In one example, each of the second surface 1014 of the center plate 1010 and the second surfaces 1034 of the wings 1030 can include a first label, mark, or color to indicate that the back plate 1000 is in a smaller configuration when the second surface 1014 of the center plate 1010 and the second surfaces 1034 of the wings 1030 are facing upward (as is shown in FIGS. 10A and 10B). In another example, each of the first surface 1012 of the center plate 1010 and the first surfaces 1032 of the wings 1030 can include a second label, mark, or color to indicate that the back plate 1000 is in a larger configuration when the first surface 1012 of the center plate 1010 and the first surfaces 1032 of the wings 1030 are facing upward (as is shown in FIGS. 10C and 10D).

Figure 11B:
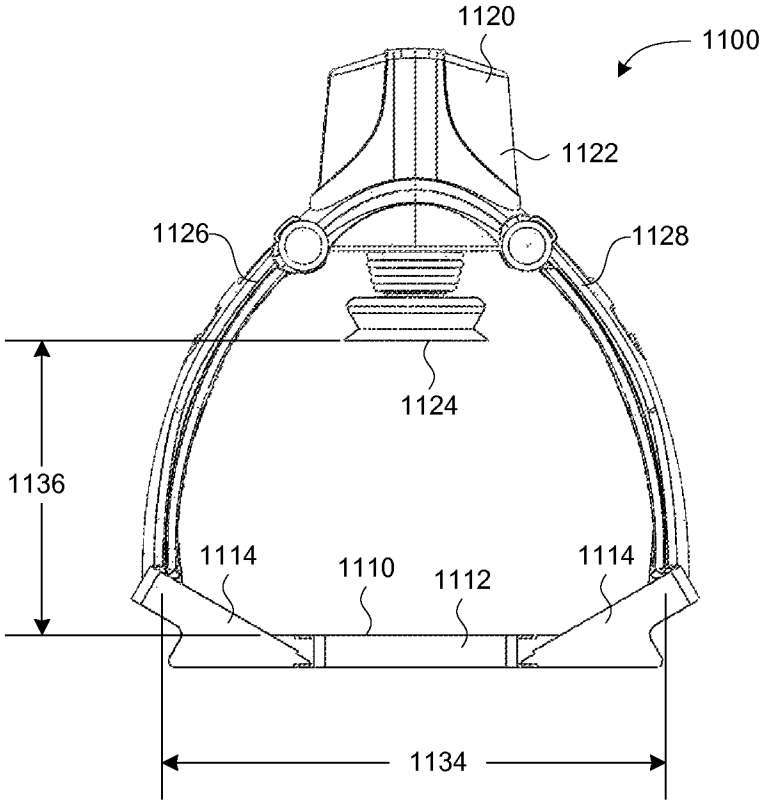
FIGS. 11A and 11B depict two configurations of an embodiment of a mechanical CPR compression device with a back plate and a compression device.
Figure 11A:
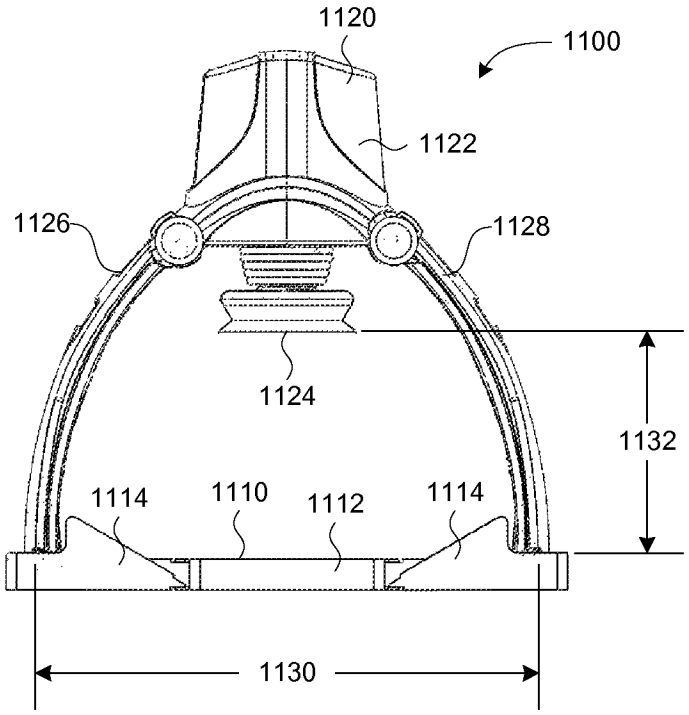

FIGS. 11A and 11B depict two configurations of an embodiment of a mechanical CPR compression device 1100 with a back plate 1110 and a compression device 1120. The back plate 1110 includes a center plate 1112 and two wings 1114 rotatably attached to the center plate 1112. The center plate and wings are placed with one surface down in FIG. 11A and the center plate and wings are placed with the other surface down in FIG. 11B. The compression device 1120 includes a main portion 1122, a piston 1124, and legs 1126 and 1128. In the configuration shown in FIG. 11A, each of the legs 1126 and 1128 can be releasably connected to a first static attachment mechanism of one of the wings 1114. The connection points between the wings 1114 and each of the legs 1126 and 1128 can be a distance 1130 from each other. The piston 1124 can be located at a distance 1132 from the nearest surface of the center plate 1112. In the configuration shown in FIG. 11B, each of the legs 1126 and 1128 can be releasably connected to a second static attachment mechanism of one of the wings 1114. The connection points between the wings 1114 and each of the legs 1126 and 1128 can be a distance 1134 from each other. The piston 1124 can be located at a distance 1136 from the nearest surface of the center plate 1112. The distances 1130 and 1134 in each of the configurations can be the same. The distances 1132 and 1136 in each of the configurations can be different, with the distances 1136 being greater than the distance 1132.

Figure 12B:
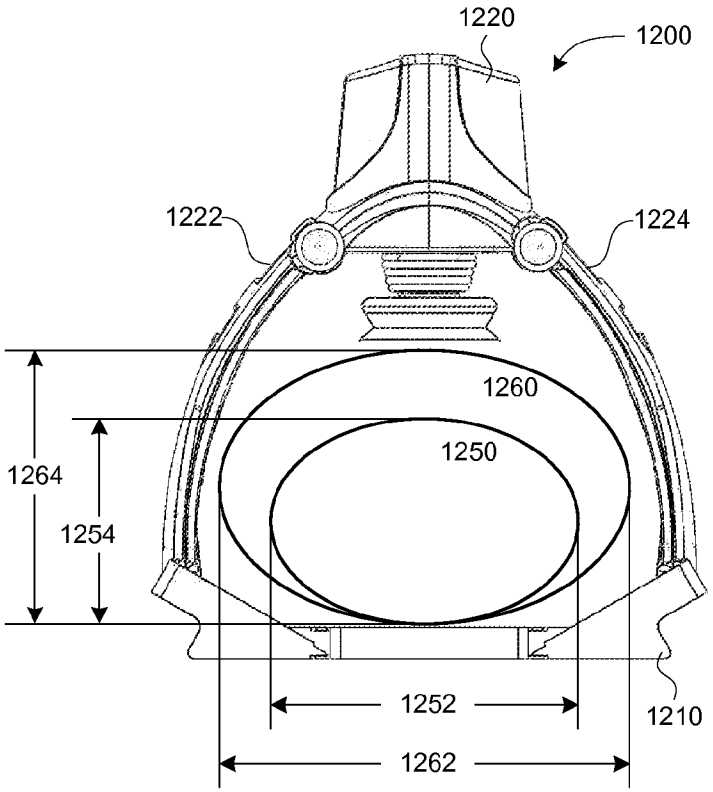
FIGS. 12A and 12B depict a smaller configuration and a larger configuration, respectively, of an embodiment of a mechanical CPR compression device with a two-wing back plate and a compression device.
Figure 12A:
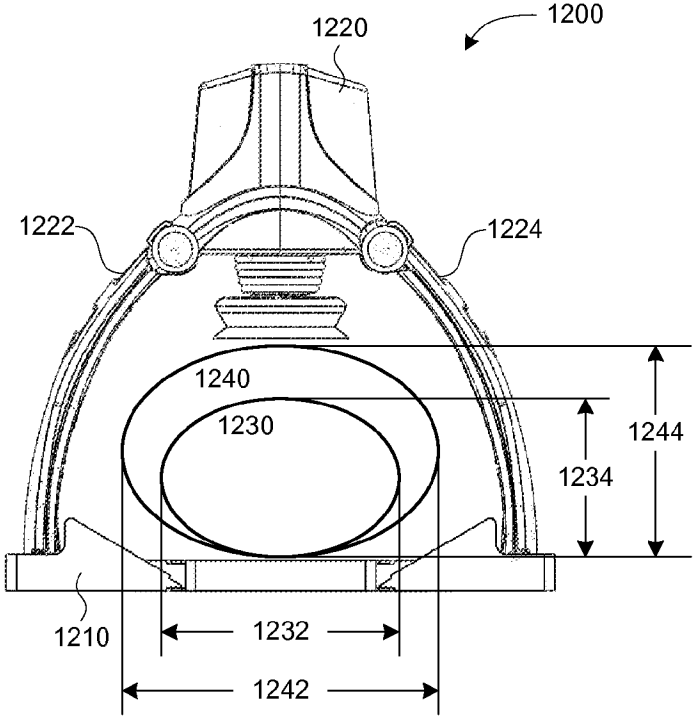

FIGS. 12A and 12B depict a smaller configuration and a larger configuration, respectively, of an embodiment of a mechanical CPR compression device 1200 with a two-wing back plate 1210 and a compression device 1220. The two-wing back plate is placed on one side in the configuration shown in FIG. 12A and on another side in the configuration shown in FIG. 12B. In the smaller configuration depicted in FIG. 12A, the mechanical CPR compression device 1200 can accommodate patient chest sizes in a range from chest size 1230 to chest size 1240. The chest size 1230 has a width 1232 and a sternum height 1234, and the chest size 1240 has a width 1242 and a sternum height 1244. Thus, in the smaller configuration, mechanical CPR compression device 1200 can be used with patients having a chest width between width 1232 and width 1242, and having a sternum height between sternum height 1234 and sternum height 1244. In the larger configuration depicted in FIG. 12B, the mechanical CPR compression device 1200 can accommodate patient chest sizes in a range from chest size 1250 to chest size 1260. The chest size 1250 has a width 1252 and a sternum height 1254, and the chest size 1260 has a width 1262 and a sternum height 1264. Thus, in the larger configuration, mechanical CPR compression device 1200 can be used with patients having a chest width between width 1252 and width 1262, and having a sternum height between sternum height 1254 and sternum height 1264. If chest size 1240 is larger than chest size 1250, then the mechanical CPR compression device 1200 is usable with patients having chest sizes in a range from chest size 1230 to chest size 1260. In other words, mechanical CPR compression device 1200 can be used with patients having a chest width between width 1232 and width 1262, and having a sternum height between sternum height 1234 and sternum height 1264.

Conditional language used herein, such as, among others, "can," "could," "might," "may," "e.g.," and the like, unless specifically stated otherwise, or otherwise understood within the context as used, is generally intended to convey that certain examples include, while other examples do not include, certain features, elements, and/or steps. Thus, such conditional language is not generally intended to imply that features, elements and/or steps are in any way required for one or more examples or that one or more examples necessarily include logic for deciding, with or without author input or prompting, whether these features, elements and/or steps are included or are to be performed in any particular example. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

In general, the various features and processes described above may be used independently of one another, or may be combined in different ways. For example, this disclosure includes other combinations and sub-combinations equivalent to: extracting an individual feature from one embodiment and inserting such feature into another embodiment; removing one or more features from an embodiment; or both removing a feature from an embodiment and adding a feature extracted from another embodiment, while providing the advantages of the features incorporated in such combinations and sub-combinations irrespective of other features in relation to which it is described. All possible combinations and subcombinations are intended to fall within the scope of this disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed example examples. The example systems and components described herein may be configured differently than described. For example, elements may be added to, removed from, or rearranged compared to the disclosed example examples.

While certain example or illustrative examples have been described, these examples have been presented by way of example only, and are not intended to limit the scope of the inventions disclosed herein. Indeed, the novel methods and systems described herein may be embodied in a variety of other forms. The accompanying claims and their equivalents are intended to cover such forms or modifications as would fall within the scope and spirit of certain of the inventions disclosed herein.

What is claimed:

1. A back plate for use with a compression device, the back plate comprising:

an upper portion;

a lower surface defining a plane;

a first side and a second side;

a plurality of first static attachment elements configured to releasably connect to legs of the compression device; and a plurality of second static attachment elements configured to releasably connect to legs of the compression device;

wherein each of the first and second sides comprises one of the plurality of first static attachment elements and one of the plurality of second static attachment elements;

wherein a distance between the one of the plurality of second static attachment elements on the first side and the one of the plurality of second static attachment elements on the second side is greater than a distance between the one of the plurality of first static attachment elements on the first side and the one of the plurality of first static attachment elements on the second side; and wherein a distance from the plane to one of the plurality of second static attachment elements is greater than a distance from the plane to one of the plurality of first static attachment elements.

2. The back plate of claim 1, wherein the plurality of first static attachment elements and the plurality of second static attachment elements are formed as integral portions of the back plate.

3. The back plate of claim 1, wherein the plurality of first static attachment elements and the plurality of second static attachment elements are formed separately from the back plate.

4. The back plate of claim 3, wherein the plurality of first static attachment elements and the plurality of second static attachment elements are shafts.

5. The back plate of claim 4, wherein the shafts are connected to portions of the back plate via fasteners.

6. The back plate of claim 1, wherein the back plate comprises glass reinforced crystalline plastic.

7. The back plate of claim 1, wherein the lower surface comprises a plurality of ribs that run from the first side to the second side, and wherein the plane is defined in part by the plurality of ribs.

8. The back plate of claim 1, wherein each of the first side and the second side has a curved shape away from the plane.

9. A mechanical compression system, comprising:

a back plate comprising an upper portion, a lower surface defining a plane, a first side, a second side, a plurality of first static attachment elements, and a plurality of second static attachment elements, wherein each of the first and second sides comprises one of the plurality of first static attachment elements and one of the plurality of second static attachment elements, wherein a distance between the one of the plurality of second static attachment elements on the first side and the one of the plurality of second static attachment elements on the second side is greater than a distance between the one of the plurality of first static attachment elements on the first side and the one of the plurality of first static attachment elements on the second side, and wherein a distance from the plane to one of the plurality of second static attachment elements is greater than a distance from the plane to one of the plurality of first static attachment elements; and a compression device comprising a main portion, a first leg attached to the main portion, and a second leg attached to the main portion;

wherein the first leg is configured to be releasably connected to one of the plurality of first static attachment elements on the first side and the second leg is configured to be releasably connected to one of the plurality of first static attachment elements on the second side in a first configuration, and wherein the first leg is configured to be releasably connected to one of the plurality of second static attachment elements on the first side and the second leg is configured to be releasably connected to one of the plurality of second static attachment elements on the second side in a second configuration; and wherein an area bounded by the upper portion, the first leg, the main portion, and the second leg is larger in the second configuration than in the first configuration.

10. The mechanical compression system of claim 9, wherein the compression device further comprises a piston configured to extend toward the upper portion of the back plate.

11. The mechanical compression system of claim 10, wherein a distance from the piston to the upper portion is greater in the second configuration than in the first configuration.

* * * * *